United States Patent [19]

Leach

[11] 4,285,303

[45] Aug. 25, 1981

[54] SWASH PLATE INTERNAL COMBUSTION ENGINE

[76] Inventor: Charles Leach, P.O. Box 212, Redwood Valley, Calif. 95470

[21] Appl. No.: 31,320

[22] Filed: Apr. 19, 1979

[51] Int. Cl.[3] ..... F02B 75/26

[52] U.S. Cl. ..... 123/51 BA; 123/58 BC

[58] Field of Search ..... 123/58 R, 58 B, 58 BA, 123/58 BB, 51 R, 51 B, 51 BB, 51 BD, 41.37

[56] References Cited

U.S. PATENT DOCUMENTS

| | | | |
|---|---|---|---|
| 1,950,970 | 3/1934 | Chilton | 123/58 BB |
| 2,150,162 | 3/1939 | Hall | 123/58 BC |
| 2,403,283 | 7/1946 | Holmes | 123/58 BB |
| 3,250,931 | 5/1966 | Hardman | 123/41.37 |
| 3,866,581 | 2/1975 | Herbert | 123/51 B |

FOREIGN PATENT DOCUMENTS

| | | | |
|---|---|---|---|
| 1906171 | 8/1969 | Fed. Rep. of Germany | 123/58 R |

*Primary Examiner*—Craig R. Feinberg
*Attorney, Agent, or Firm*—F. Travers Burgess

[57] ABSTRACT

A two-cycle internal combustion engine has a plurality of parallel cylinders supporting a central drive shaft, a piston in each cylinder having an outer extension connected to a swash plate rotatably mounted on an inclined portion of the drive shaft. The swash plate adjacent portions of the drive shaft and the connection of the piston rods to the swash plate are in sealed oil-filled chambers at opposite ends of the cylinders. Ball and socket joints by which the pistons are connected to the swash plates are slidable radially of the swash plate to function as pumps forcing oil from the swash plate chamber through central tubes in hollow extensions into the pistons for lubricating and cooling the pistons and cylinders, after which the oil returns through the hollow piston rods to the oil chamber. Preferably the invention is embodied in an opposed piston engine having swash plates adjacent both ends of the cylinder.

10 Claims, 13 Drawing Figures

SWASH PLATE INTERNAL COMBUSTION ENGINE

BACKGROUND OF THE INVENTION

1. Field of the Invention

The invention relates to internal combustion engines and more particularly to an improved lubricating system for an engine of the swash plate type.

2. Prior Art

Most engines of the swash plate type utilize piston rods universally pivoted to the pistons at one end and at their other end universally pivoted to the swash plate to transmit reciprocating movements of the pistons, to the swash plate, as exemplified in Clessie L. Cummins U.S. Pat. No. 3,528,394 in which lubricating oil is supplied from a reservoir 123 under pressure by a pump 125 to a central passage in the crankshaft and therefrom through radial passages in the swash plates into the ball joints connecting the piston rods to the swash plates from which it passes via the hollow piston rods into the pistons themselves. The lubricating system of Cummins requires external pressure furnished by lubricant pump 125 to force the lubricant through the swash plate and piston rod passages into the pistons. R. Y. Bovee U.S. Pat. No. 2,427,868 and Meijer U.S. Pat. No. 4,030,404 both show swash plate engines in which the piston rods are rigid with the pistons, tipping of the swash plate with respect to the rigid piston rod being accommodated by ball and socket connections between the piston rods and the swash plate which are slidable parallel to the planes of the swash plates. Neither of these patents utilizes the relative movements between the piston rods and swash plates as a means for pumping lubricant into the pistons.

SUMMARY OF THE INVENTION

The invention provides a swash plate engine in which the pistons have rigid axial extensions connecting them to the swash plate or plates, necessary radial movement of the rigid piston extensions with respect to the swash plates being accommodated by radially slidable mountings of the ball joints to the swash plates, such that such relative radial movements provide a pumping action for directing lubricant in the swash plate chambers into hollow piston rods and thence into the pistons for emission into the interfaces between the pistons and cylinders.

Among the objects and advantages of the invention are the following:

The engine has no crank shaft with the usual multiplicity of plain bearings and great bearing surface movements. Instead it has ball and socket joints and large roller bearings. Only slight movement is required in the ball and socket joints and the roller bearings offer much less friction than the multiplicity of plain bearings in the usual engine.

The engine does not have angularly swinging connecting rods with their resultant transverse force components on the pistons. Instead it utilizes axial motion only of the piston extensions rigidly connecting the pistons to the ball and socket bearings in the swash plates.

The engine does not have poppet valves or a cam shaft. Instead it utilizes the rear surface of the piston to precompress the fuel and air mixtures in a positively lubricated two cycle system with none of the disadvantages of a conventional two cycle engine in which lubrication is provided by adding oil to the fuel. In the engine metered oil is supplied from the piston for lubrication. This engine also has a power stroke for every piston for every revolution of the fly wheel with reliability of a four cycle engine.

Although the explosion of the fuel mixture in an engine exerts force in all directions, a conventional engine utilizes this force in only one direction. Conversely, in my engine the force of the explosion is used in two directions because of the pair of opposed pistons in each cylinder. In addition to using the explosions more effectively, as referred to above, this provides an effective long stroke combustion chamber with short piston travel. The long stroke combustion chamber provides much higher efficiency and the short stroke of the pistons reduces wear and permits higher speeds. It permits the use of high explosive fuel, such as hydrogen, because it relieves the violent flame front in two directions and reduces the instantaneous forces on the engine.

The lubrication system of this engine is highly advantageous. The exterior peripheral surface of each ball socket used to transmit piston movement to the swash plates functions as an oil pump as it moves radially of the swash plate, thus providing a source of oil pressure to each piston. The oil under pressure first lubricates the ball and socket joint and then flows through a first passage in each hollow piston extension into the piston, cooling it and lubricating the rings, and thereafter discharges through the hollow piston extension to a back pressure controller through which it is returned to the crank case. The back pressure control determines the amount of oil released under each piston ring to effect lubrication of the piston. Thus, each of the eight ball and socket joints connecting the eight pistons to the two swash plates functions as an oil pump making unnecessary the provision of a separate oil pump. Each group of four ball and socket joints in the respective swash plates has a common intake port and the outlets are connected so as to equalize oil pressure and ensure reliability of oil flow to all pistons. Oil in the engine stays clean because the cylinders are sealed from the crank cases by pressure rings in the piston extension guides.

The straight axial movement of the piston connections to the swash plates permits the use of round pistons because of the elimination of rocking movements. The permissible high compression ratios make possible the use of a leaner fuel mixture thus improving efficiency and reducing pollutants. If hydrogen is used as fuel, the end product of combustion is steam, which as water vapor in the air is breathable.

Inertial forces in the engine are balanced by reason of mass movements of the engine parts in each end of the engine always being 180° out of phase with each other.

Cooling of the engine is accomplished simply by means of a squirrel cage blower fan on the drive shaft in the space surrounded by the cylinders.

Higher than conventional compression ratios are practical in this engine because of the straight line connection of the pistons to the swash plates and the fact that the charge is compressed from two directions by the two pistons in each cylinder.

DETAILED DESCRIPTION OF THE INVENTION

Figure 1:
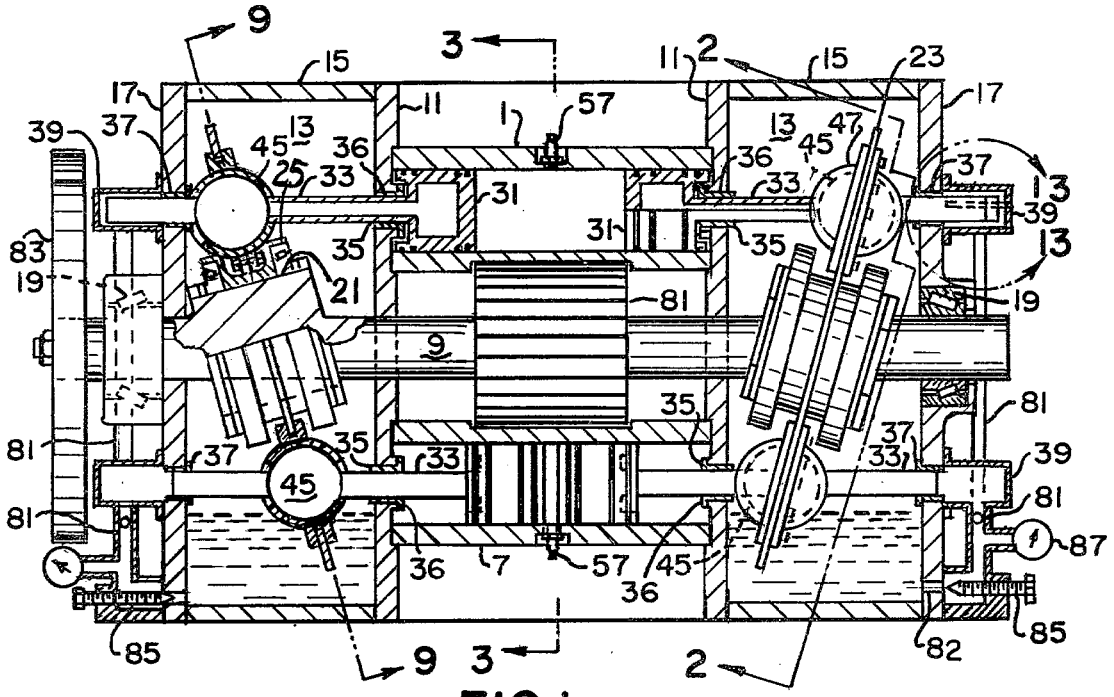
FIG. 1 is a longitudinal diametral section of an engine constructed in accordance with the invention.
Figure 2:
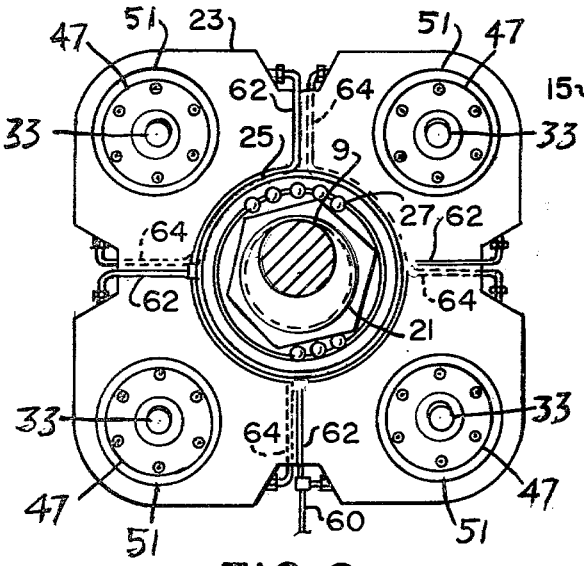
FIG. 2 is an oblique section taken along line 2—2 of FIG. 1, showing an end elevation of one of the swash plates.
Figure 3:
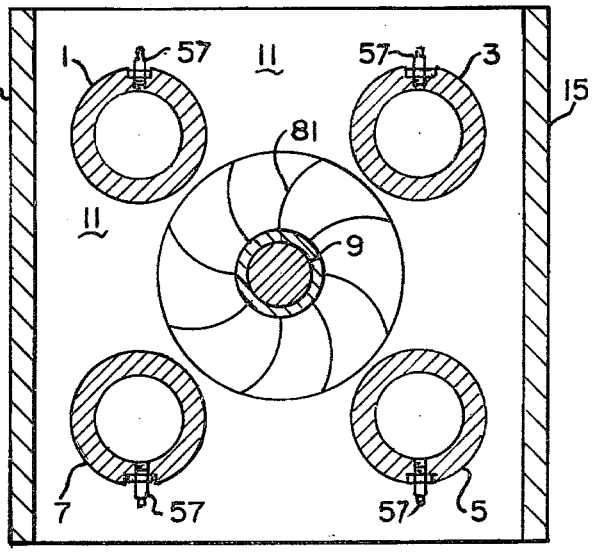
FIG. 3 is a transverse vertical sectional view taken along line 3—3 of FIG. 1.
Figure 4:
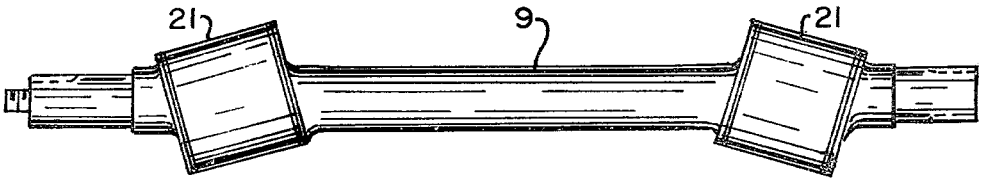
FIG. 4 is an elevational view of the engine drive shaft.
Figure 5:
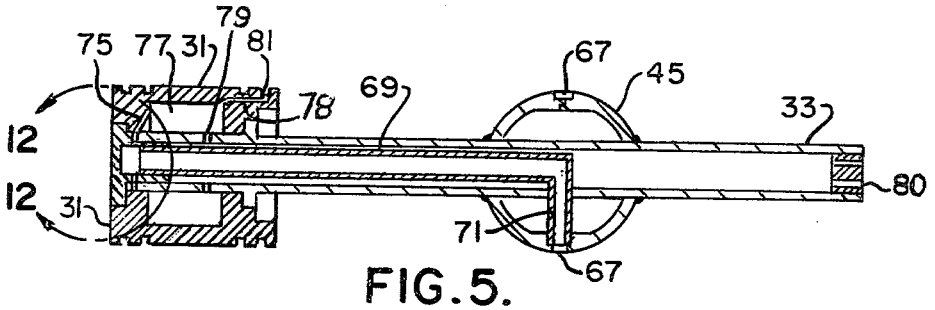
FIG. 5 is a longitudinal vertical sectional view of a piston and piston rod assembly used in the engine illustrated in FIGS. 1-3.

The invention as best seen in FIGS. 1-3 has four cylinders 1, 3, 5 and 7 equiangularly spaced around a drive shaft 9 and extending parallel thereto. A pair of spaced rectangular plates 11 extend transversely of cylinders 1-7 and drive shaft 9 and form the ends of the cylinders. Plates 11 are centrally apertured to permit the passage therethrough of drive shaft 9 and form the inner walls of lubricant chambers 13 each having a peripheral wall 15 and an end wall 17 parallel to and spaced from transverse walls 11. End walls 17 are centrally apertured and enclose anti-friction bearing devices, preferably thrust resistant roller bearings rotatably mounting drive shaft 9.

Centrally within each of the chambers 13 drive shaft 9 is formed with swash plate journal surfaces 21, the axes of which are slightly inclined symmetrically in opposite directions with respect to the longitudinal axis of drive shaft 9 and generally square swash plates 23 are formed with a central bearing aperture 25 rotatably receiving the respective journal portions 21. Thrust resistant ball bearings 27 are interpositioned between drive shaft journals 21 and swash plate bearing aperture 25 to permit free rotation of the drive shaft with respect to the swash plates while preventing movement of the swash plates axially of the drive shaft journal portions 21 so that opposite reciprocating movements of the rollers of the swash plates will produce continuous unidirectional rotational movement of drive shaft 9.

Figure 10:
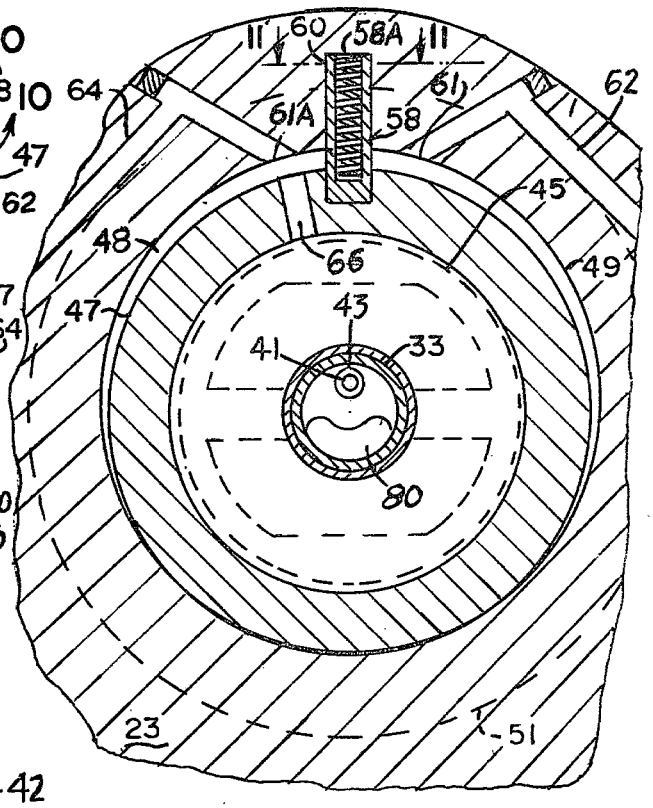
FIG. 10 is an enlarged fragmentary view of a corner of one of the swash plates and included ball and socket joint.
Figure 11:
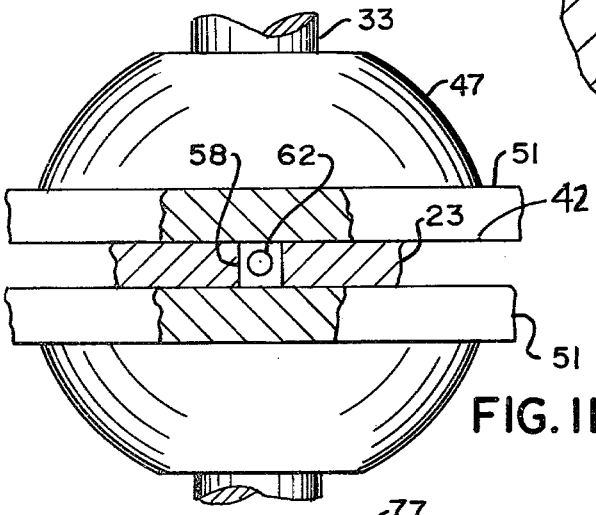
FIG. 11 is a fragmentary elevational view of the swash plate and associated ball and socket joint taken along line 11—11 of FIG. 10.
Figure 13:
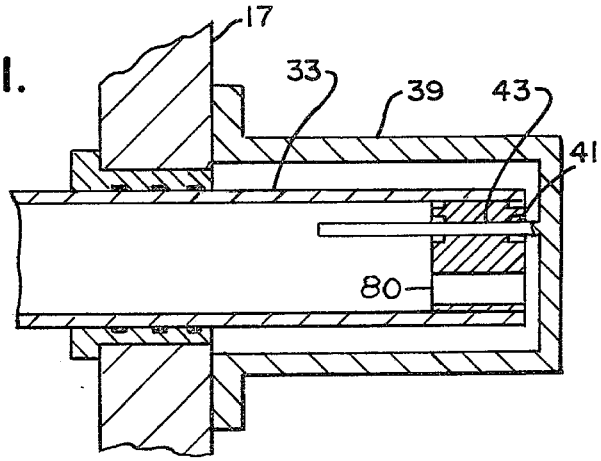
FIG. 13 is an enlarged diametral fragmentary sectional view of the piston rod and area surrounded by line 13—13 of FIG. 1.
Figure 12:
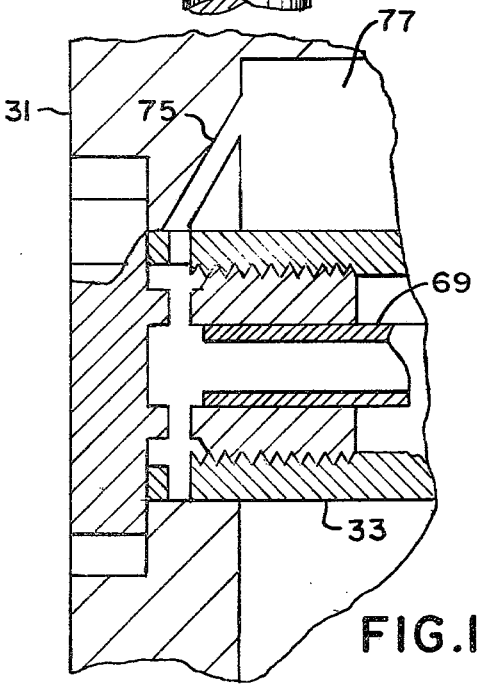
FIG. 12 is an enlarged diametral section through one of the piston heads corresponding to the area surrounded by the line 12—12 of FIG. 5.

For providing the necessary reciprocating movements of the swash plate corners, a pair of opposed pistons 31 is slidably mounted in each of the cylinders 1-7. Each piston 31 has a rigid axial extension 33 protruding outwardly through the adjacent cylinder end wall 11 which is suitably apertured at 35 for this purpose, the apertures 35 being provided with a closely fitting seal 36 surrounding the respective piston extensions 33, the extremities of which are slidably received in similarly sealed apertures 37 in end walls 17. Sealed apertures 35 and 37 also service as guides for piston extensions 33. The protruding ends of piston extensions 33 extend into cap members 39 which are secured to the outer surfaces of end wall 17 and are sufficiently elongated to permit full reciprocation of the respective piston rods. As best seen in FIG. 13, each of the cap members 39 is formed with an inwardly extending pin 41 which is slidably received in a hole 43 in the end of the respective piston extension 33 so as to prevent rotation of the pistons about their axes in the cylinders. Intermediate the ends of piston extensions 33 each of the piston rods is formed with a ball 45 which is slidably received in a ball socket 47 slidably mounted in an aperture 49 in the respective swash plates 23 by means of spaced double flanges 51. Apertures 49 are substantially circular, of slightly larger diameter than the exterior of the ball socket 47 so as to define crescent shaped spaces 48 between apertures 49 and the peripheries of the ball sockets 47. The ball sockets are provided with apertures 53 on a diameter substantially normal to the swash plate. Apertures 53 are of substantially greater diameter than the piston extensions 33 to permit necessary turning movements of balls 45 in the respective sockets 47. As best seen in FIG. 10, a barrier plug 58 is slidably mounted in a recess 60 in the swash plate radially outwardly of each aperture 49. Each of the barrier plugs 58 is oriented radially of the swash plate and of the associated aperture 49 and is backed by a compression spring 58A to bias the respective barrier plug 58 into contact engagement with its seat 58B in the associated ball socket.

Each of the cylinder and piston assemblies is arranged to function as a two-cycle opposed piston engine, a single spark plug 57 being located at the center of each cylinder wall.

Figure 6:
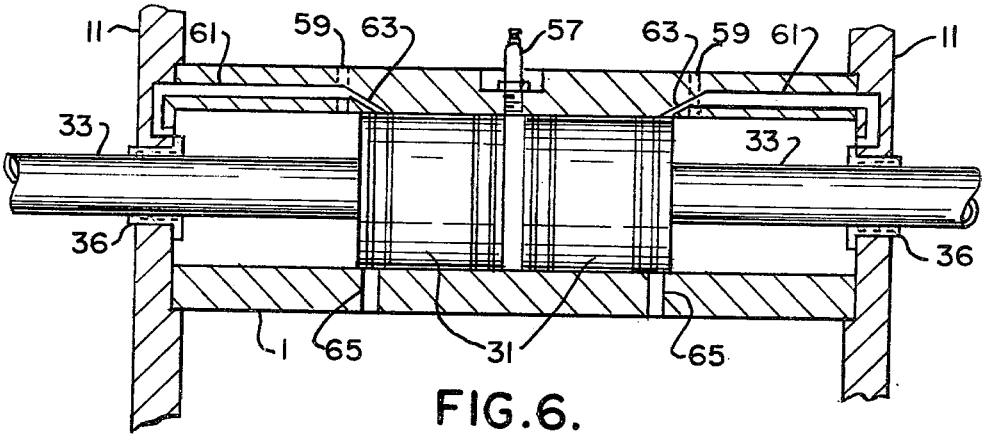
FIG. 6 is an enlarged longitudinal diametral section through one of the cylinders showing intake and exhaust ports and fuel mixture transfer cavities.
Figure 7:
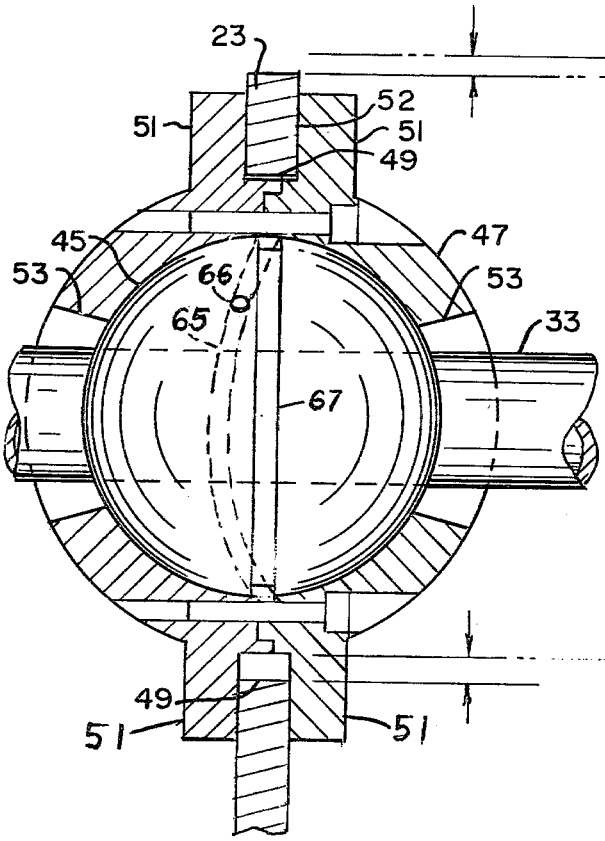
FIGS. 7 and 8 illustrate respectively the construction of the socket for the ball and socket connections between the respective piston rods and the respective swash plates.
Figure 8:
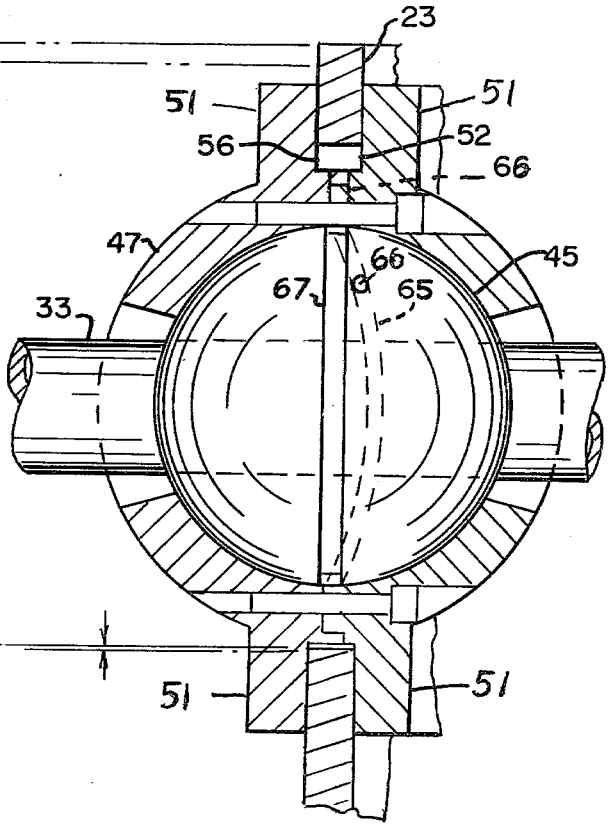

As best seen in FIG. 6, each cylinder is provided with a continuously open intake port 59 immediately rearwardly of the innermost position of the respective piston so that when the pistons are in the innermost or compression positions fuel mixture will be admitted to the spaces between the rear of the pistons and the end walls 11 and during the power stroke of the pistons, in which the pistons move rearwardly toward the cylinder end walls 11, the fuel mixture thus introduced will be compressed in this space. For introducing the compressed fuel mixture into the combustion chamber and central portion of the cylinder between the opposing forces of the pistons, transfer passages 61 connect the end walls of the cylinder to fuel inlet ports 63 in the cylinder walls, intersecting the combustion chamber portion of the cylinder a slight distance inwardly from the opposing faces of the respective pistons when the pistons are in their outermost positions, i.e., near the cylinder end walls 11. Inlet orifices 63 are slightly inclined toward the center of the cylinder so that their axes intersect substantially at the center of the cylinder such that, when the pistons have moved to their outermost positions in the cylinder, the compressed fuel mixture will be directed into the central portion of the combustion chamber portion of the cylinder. Also near the faces of the pistons when in their outermost positions, each cylinder is formed with an exhaust port 65. With this arrangement it will be seen that upon ignition of the compressed fuel mixture between the pistons, the pistons will be forced outwardly, first uncovering exhaust ports 65 and permitting the highly compressed exploded gases to escape therethrough and shortly thereafter uncovering the transfer inlet orifices 63 such that, upon the compression stroke of the pistons, the gases received through the inlet orifices 63 will be compressed into the narrow space between the pistons in their innermost positions, spark plug 57 will ignite the gases, exploding them and causing both pistons to move symmetrically to their outermost positions.

As the pistons 31 reciprocate in the respective cylinders their piston rods 33 cause the respective corners of the swash plates to oscillate in a direction generally parallel to the drive shaft, thus imparting unidirectional rotary motion to the drive shaft through their non-axial but relatively rotatable mounting on the inclined journal portions 21 of the drive shaft. It will be noted that the piston rods 33 are not pivoted to the pistons but are fixed to them and act in a direction completely axial of the cylinders, this being permitted by the slidable mounting of ball sockets 47 on the swash plates.

Figure 9:
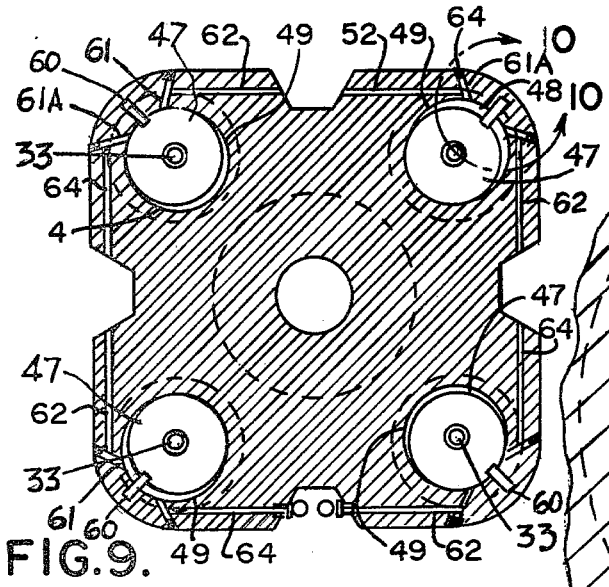
FIG. 9 is a central planar section through one of the swash plates taken along line 9—9 of FIG. 1 parallel to the faces of the swash plate.

By reference to FIGS. 9 and 10, particularly, it will be seen that although ball sockets 47 do not rotate in swash plate apertures 49, the ball sockets do shift in the respective apertures so that the points of tangency P between the ball sockets and the edges of the respective apertures move in a clockwise direction and the point of tangency acts like an impeller vane on a rotary pump. For admitting lubricant from the chambers 13 to the spaces 56 defined by apertures 49 and ball sockets 47, inlet ports 61, intersecting the respective apertures 49 a slight distance clockwise from barrier plugs 58, are connected by passageways 62 to a common lubricant inlet 60 at the bottom of the respective swash plates. The outlet of lubricant from each space 56 is a radial port 66 through the ball socket, connecting the space 56 to an internal circumferential groove 65 in the ball socket inner surface, which in turn at all times intersects an external circumferential groove 67 in the ball. Circumferential grooves 65 and 67 move between aligned and disaligned positions to wipe lubricant contained in them against the opposed surfaces of ball and socket and thoroughly lubricate these surfaces. As the point of tangency P rotates from a position adjacent barrier plug 58 in a clockwise direction, causing the space 56 to enlarge forwardly of barrier plug 58, the vacuum created therein draws lubricant into this space through lubricant inlet 60, passages 62 and lubricant inlet port 61, and as the point of tangency continues to rotate the lubricant ahead of it in the crescent-shaped space 56, is forced through radial port 66 and into the circumferential groove 65 and thence into circumferential groove 67. An internal tube 69 in each piston rod 33 communicates via a radial branch 71 within each ball with groove 67, such that lubricating oil trapped in the space defined by grooves 52 and the swash plates will be forced from this space during movement of the ball socket with respect to the swash plates, causing such lubricant to pass through passageway 63 into internal ball socket groove 65 and therefrom into intersecting ball groove 67 and thence into lateral passage 71 of piston rod internal tube 69, from the end of which it will pass through radial passage 75 in the piston into the oil cavity 77 within the piston to cool the piston, some oil being forced through passage 78 into piston ring groove 81, there to lubricate the ring and cylinder surface. The remaining lubricant in chamber 77 passes through oil outlet passage 79 into the hollow piston rod 33 and then out of port 80 in the end of the piston extension into the respective back pressure cap members 39, from which the lubricant is discharged back into the respective lubricant chamber. To equalize pressure throughout the lubrication system, the spaces 56 are all provided with pressure equalizing ports 61A, which in turn are interconnected by pressure passages 64.

To control the back pressure, back pressure cap members 39 at each end are connected by passageways 81A to an orifice 82 in the adjacent engine end wall 17, orifice 82 being adjustable by a manually-actuated conical valve member 85, the oil pressure in passageways 81A being readable on a connected pressure gauge 87, such that the back pressure can be regulated by manipulating manual valve member 85 to vary the size of orifice 83.

It will be noted that the admission of oil to the peripheral chambers 52 on the ball sockets 47 and from there into the grooves in the ball sockets and balls lubricates the flat interfaces between the ball sockets and the swash plates and also the spherical interfaces between the balls and the ball sockets, and also cools the pistons. The emission of a part of the oil into the region of the piston rings by means of piston passages 78 connecting the piston oil chambers to the periphery of the pistons, lubricates the interfaces between the pistons and cylinders.

The engine is air-cooled by a centrally positioned squirrel cage blower fan 81 mounted on the central portion of drive shaft 9 in the space surrounded by cylinders 1–7.

Flywheel 83 is mounted on and keyed to one end of output shaft 9 outwardly of the engine.

Operation of the engine is as follows: Fuel mixture is admitted to the spaces within the respective cylinders 1–7 when the pistons 31 are in the position shown at the bottom of FIG. 1 and in FIG. 6; as pistons 31 move rearwardly, i.e., toward cylinder end walls 11, the fuel mixture in the spaces between the pistons and end wall 11 is highly compressed so that when the heads of the pistons pass behind the transfer passage outlets 63 near the ends of their stroke, fuel mixture in the transfer passages is directed into the center of the respective cylinders. The pistons 31 are then caused to move inwardly by the action of the pistons in the other cylinders on the swash plates, again compressing the fuel mixture into the space remaining between the pistons when they are in the fully inward positions as shown in the lower part of FIG. 6 and in FIG. 6, at which time the respective spark plugs 57 are energized to ignite the highly compressed fuel mixture. The resultant explosion of the mixture is used in two directions against the heads of the opposed pistons, forcing them towards the ends of the respective cylinders and causing their piston rods to move the respective corners of both swash plates towards the ends of the engine, at the same time producing rotation of the output shaft 9 and causing the pistons connected to the adjacent corners of the swash plates to be moved inwardly of the cylinder towards the center of their cylinders to compress the fuel mixture in their cylinders. As the pistons in cylinder 7 move outwardly to produce the movement just described of the swash plates, drive shaft 9 and the compressed stroke of pistons 31 in cylinder 1, and as pistons 31 in cylinder 7 clear exhaust ports 65, the highly compressed exploded gases between pistons 31 in cylinder 7 are expelled by their own pressure through exhaust ports 65. As soon as the pistons 31 in cylinder 7 have cleared transverse passage inlet ports 63, the fuel mixture compressed behind pistons 31 in cylinder 7 are introduced to the combustion chamber and are directed toward the center thereof. Meanwhile, pistons 31 in cylinder 1 are compressing the fuel mixture received through the transfer passage outlet 63 in cylinder 1 and as soon as the pistons in cylinder 1 reach their innermost positions, spark plug 57 in cylinder 1 fires, exploding the mixture therein and causing the pistons 31 in cylinder 1 to move outwardly, i.e., towards cylinder end walls 11, causing similar movement of the corner of the swash plates to which they are secured and causing the opposite corners to which pistons 31 in cylinder 7 are secured to move inwardly, thereby causing the pistons in cylinder 7 to compress the fuel mixture therein into the small space between the pistons when the pistons are at their innermost positions, at which time the spark plug 57 in cylinder 7 fires, exploding the mixture and causing the pistons in cylinder 7 to move outwardly as described above, etc.

The movement of the pistons and piston rods 33 is transmitted to the swash plates through balls 45 on the respective piston extensions and ball sockets 47. As the piston extensions move in straight axial directions because of their slidable mountings in cylinder end walls 11 and engine end walls 17 and their rigid connections to the respective pistons 31, the arcuate movement of the corresponding portions of the swash plates is accommodated by sliding of the ball sockets 47 in their enlarged apertures 49 in the swash plates in directions radial of the swash plates, as may be best appreciated by reference to FIG. 9.

During movements of the ball sockets in their swash plate apertures, oil from the respective chambers 13 is drawn via connected suction passages 62 into the spaces 56 between the respective ball sockets and their apertures through the respective inlet ports 61, such that upon movement of the points of tangency between the ball sockets and the respective apertures in the swash plates, the fluid in the space between the swash plate aperture rims and the exterior of the ball sockets is forced through ports 66 into ball socket internal groove 65 and thence into ball external grooves 67 from which it passes through lateral passage 71 in the respective ball 45 to internal tube 69 in the respective piston extension 33 and therefrom through lateral passage 75 in the respective piston to the oil cooling cavity 77 therein, some of it passing through restricted orifice 78 into the piston ring groove 81 of the pistons thereby lubricating the interfaces between the pistons and the cylinder walls. Most of the oil in cavities 67 passes through return ports 79 in the piston rod exterior rod into the piston rod and thence out of the end of the piston rod through outlet port 80 and back pressure control system 39, 81–87 into the lubricant chambers 13, the cycle being repeated and being continuous as long as the pistons are caused to reciprocate. Thus, the pistons are continuously lubricated and the cylinders are cooled by the continuous admission of oil to the cooling cavity 77 in each piston. This arrangement eliminates the problem present in many two-cycle engines in which the only means for lubricating the pistons and cylinder walls is to add oil to the fuel, whereas in the present engine metered oil is supplied to the pistons for lubrication as described above. It will be noted from the foregoing that the ball and socket connections between the piston rods and the swash plates function as oil pumps so that each piston has its exclusive oil pressure source, the pressured oil first lubricating the ball and socket joint, then flowing through the internal tube in each piston rod to the inside of the piston cooling it and discharging back through the hollow piston rod to the back pressure controller before it is discharged into the crank case, the amount of back pressure thus controlling the amount of oil released under the piston rings to lubricate the piston. With this arrangement, each engine has in effect eight oil pumps requiring no additional pump structure.

The details of the construction may be varied substantially without departing from the spirit of the invention and the exclusive use of those modifications as come within the scope of the appended claims is contemplated.

I claim:

1. An internal combustion engine having at least a pair of parallel cylinders, a drive shaft parallel to and symmetrically disposed with respect to said cylinders, said drive shaft having a journal portion inclined to its axis, a swash plate held against rotation and mounted on said journal portion to produce rotation of said drive shaft, a piston in each of said cylinders having a rigid axial extension arranged for axial movement only relative to the respective cylinder, and connections of said piston extensions to said swash plate for transmitting axial movements of said extensions to said swash plate and thereby producing rotation of said drive shaft, said connections being reciprocable radially of said swash plate journal portion and parallel to the plane of said swash plate, wall means forming a chamber distinct from said cylinders and enclosing said swash plate, the adjacent portions of said drive shaft and of said piston extensions and said connections, said chamber being adapted to contain a liquid lubricant, each said piston extension being formed with an internal axial passage, there being an opening in said swash plate to accommodate movement of said connections relative to said swash plate, said connections defining with said opening a sealed lubricant recess having an inlet from said chamber and an outlet communicating with the respective piston extension passage, said pistons being formed with passage means connecting said piston extension passages with the peripheries of the respective pistons whereby reciprocating movements of said connections of said piston extensions to said swash plate radially with respect to said drive shaft during operation of the engine draw lubricant from said chamber into said swash plate opening and force it into said piston extension passages and therethrough into the peripheral space between the respective pistons and cylinder walls to lubricate and cool said cylinders, wherein each said connection between each piston extension and the swash plate comprises a ball mounted on the respective piston extension, and a spherical socket surrounding said ball, the openings in said swash plate being slightly larger than the periphery of said spherical socket and receiving said socket for movement therein, said socket having spaced parallel external flanges slidably embracing the opposite surfaces of said swash plate along the margin of said swash plate, whereby as the respective sockets move with respect to the swash plate, they draw lubricant into the respective opening from the chamber outwardly of said shell and force such lubricant through the tubular piston extension and piston passages into peripheral regions of said piston, and further including apertures in the wall means aligned with the respective piston extensions slidably receiving the ends of said piston extensions, covers for said piston extensions outwardly of said apertures, and passage means connecting said piston extension covers with said chamber.

2. An internal combustion engine according to claim 1, wherein each said piston extension is formed with a second internal axial passageway for returning spent lubricant from the respective piston into the associated lubricant chamber.

3. An internal combustion engine according to claim 1, including pressure passage means connecting the openings in the swash plate associated with all the respective piston extensions, said swash plate having a common lubricant inlet connected to all of said openings.

4. An internal combustion engine according to claim 1, including a selectively variable restriction in said last-named passage means for varying the back pressure in the engine.

5. An internal combustion engine according to claim 4, wherein said selectively variable restriction comprises an orifice and a screw-actuated tapered valve therein.

6. An internal combustion engine according to any of claims 1, 2, 3, 4 or 5, wherein said engine is of the opposed piston type having a pair of said pistons in each cylinder and a pair of said swash plates positioned on the end portions of said drive shaft outwardly of both ends of said cylinders, and a pair of said chambers enclosing said swash plates.

7. An internal combustion engine according to claim 6, wherein said engine is of the two-cycle type.

8. An internal combustion engine according to claim 7, wherein each said cylinder has a single centrally mounted spark plug, a pair of fuel inlet ports located respectively outwardly of the innermost positions of said pistons, and a fuel transfer passage at each end of the cylinder having an inlet in the respective ends of the cylinder and an outlet into the cylinder abreast of the respective piston and adapted to be uncovered thereby when the piston completes its power stroke, each said outlet being inclined axially of the cylinder toward the center thereof, and an exhaust port substantially opposite each said transfer passage outlet.

9. An internal combustion engine according to claim 8 including anti-friction bearings mounting said swash plates on said drive shaft.

10. An internal combustion engine according to claim 9 including a blower mounted on said drive shaft in the space surrounded by said cylinders for providing air-cooling to said engine.

* * * * *